US008813666B2

(12) United States Patent
Hoogenboom

(10) Patent No.: US 8,813,666 B2
(45) Date of Patent: Aug. 26, 2014

(54) BARRIER SYSTEM FOR INHIBITING MARINE GROWTH ON SUBMERGED COMPONENT OF BOAT

(71) Applicant: Christopher L. Hoogenboom, Beaufort, SC (US)

(72) Inventor: Christopher L. Hoogenboom, Beaufort, SC (US)

( * ) Notice: Subject to any disclaimer, the term of this patent is extended or adjusted under 35 U.S.C. 154(b) by 122 days.

(21) Appl. No.: 13/671,235

(22) Filed: Nov. 7, 2012

(65) Prior Publication Data

US 2014/0123888 A1 May 8, 2014

(51) Int. Cl.
*B63B 59/04* (2006.01)

(52) U.S. Cl.
USPC ..... 114/222

(58) Field of Classification Search
USPC ..... 114/222; 440/112, 113
See application file for complete search history.

(56) References Cited

U.S. PATENT DOCUMENTS

| | | | | |
|---|---|---|---|---|
| 3,220,374 | A * | 11/1965 | Sloan | 114/222 |
| 3,886,889 | A * | 6/1975 | Burger | 440/113 |
| 4,282,822 | A | 8/1981 | Jackson | |
| 4,998,496 | A | 3/1991 | Shaw | |

* cited by examiner

*Primary Examiner* — Lars A Olson
(74) *Attorney, Agent, or Firm* — Scot A. Reader

(57) ABSTRACT

A barrier system for inhibiting marine growth on a submerged component of a boat operates on the principle that limiting the availability of nutrients that marine organisms need to survive and thrive will inhibit the growth of marine organisms. The barrier system, by restricting the exchange of water between the body of water enclosed within the barrier system and the body of water outside of the barrier system, creates and maintains a body of stagnant water which surrounds the submerged component targeted for protection from fouling growth. The submerged component may be a mounting bracket for an outboard engine and the barrier element may be resiliently adjustable in response to the act of tilting the outboard engine.

11 Claims, 2 Drawing Sheets

BARRIER SYSTEM FOR INHIBITING MARINE GROWTH ON SUBMERGED COMPONENT OF BOAT

BACKGROUND OF THE INVENTION

Humans venturing to sea have long waged a battle against barnacles and other fouling marine growth. Barnacles and other marine growth significantly reduce hull speed, reduce fuel efficiency and are highly destructive to both sail and power boats. They are also dangerous and can cause cuts and infections to boaters unfortunate enough not to respect their razor sharp shells.

There are products, such as copper (actually cuprous oxide or $Cu_2O$) based antifouling paints, which can be applied to submerged components of a boat (i.e., components of the boat that are at least partly under water when the boat is docked or moored and provide an attractive habitat for marine organisms) to inhibit marine growth. However, some submerged components cannot tolerate copper based paint. For example, copper based paint cannot be applied to aluminum outboard engine and inboard/outboard drive components, such as outboard engine mounting brackets and inboard/outboard drive units, since the two dissimilar metals form a battery and severe electrolysis of the aluminum can occur, turning a strong metal component into aluminum oxide powder. When a boater makes the mistake of putting a copper based paint on an aluminum boat component, the outcome is an expensive lesson not soon forgotten.

As an alternative to copper based antifouling paints, marine paint manufacturers offer less effective tin based antifouling paints that are safe to use on aluminum. While tin based paints are better than nothing, they are vastly inferior antifouling agents to copper based paints. Copper based paint is effective in preventing virtually all marine growth from one to two years with very little maintenance. Moreover, after two years of continuous in the water use, often all that is required is a pressure wash and paint touch up and the copper based paint continues to be effective for another one or two years of service. Such is not the case with tin based paints. Submerged components painted with tin based paint are typically protected from marine growth for only two to three months before succumbing to some marine growth which, if left unchecked, will grow to complete coverage within six to twelve months. A typical solution is to haul the boat every two to three months and re-apply a fresh coat of the tin based paint to the components. However, such haul outs are both expensive and time consuming.

An alternative to tin based antifouling paints is addressed in U.S. Pat. No. 4,998,496, which describes surrounding the submerged portion of an inboard/outboard outdrive unit with a waterproof shroud and using an electric pump to empty the shroud of water, thereby keeping the submerged components from being in constant contact with water. Similarly, U.S. Pat. No. 4,282,822 describes placing an entire boat inside a floatable protective shroud. While these systems may work to a degree, they are expensive, complex, require an active pumping system, must be kept watertight and are very cumbersome to use. For example, the device described in U.S. Pat. No. 4,998,496 must be installed prior to storage of the boat and removed and stored prior to use of the boat. Moreover, these systems require frequent pumping for boats moored in all but the calmest of harbors. Frequent pumping requires the boat to have a battery charging system, which in turn requires the boat to be connected to grid power or an adequate solar charging system.

Another alternative to tin based antifouling paints is for the boater to periodically (e.g., monthly) scrub the submerged components or hire a dive service to do so, which is laborious and/or costly.

Still another alternative is to allow the marine growth to flourish unchecked on the submerged components, which can cause permanent damage to these components.

Accordingly, there is a need for an efficient and safe solution for inhibiting marine growth on the submerged components of a boat, particularly those that are incompatible with copper based paints.

SUMMARY OF THE INVENTION

The present invention provides a barrier system for inhibiting marine growth on a submerged component of a boat. The barrier system operates on the principle that limiting the availability of nutrients that marine organisms need to survive and thrive will inhibit the growth of marine organisms. The barrier system, by restricting the exchange of water between the body of water enclosed within the barrier system and the body of water outside of the barrier system, creates and maintains a body of stagnant water which surrounds the submerged component targeted for protection from fouling growth. The body of stagnant water does not have the supply of food required by filter feeders such as barnacles and oysters and the supply of carbon dioxide required for marine plant growth, thereby inhibiting marine growth on the submerged component surrounded by the barrier system. The barrier system does not necessarily prevent all exchange of water between the body of water enclosed within the barrier system and the body of water outside of the barrier system nor prevent all contact of the submerged component with water. Rather, the barrier system, by limiting the exchange of water between the body of water enclosed within the barrier system and the body of water outside of the barrier system, sufficiently alters the ecosystem of the body of water enclosed within the barrier element to a degree that marine growth is inhibited. In some embodiments of the present invention, the submerged component is a mounting bracket for an outboard engine and the barrier element is resiliently adjustable in response to the act of tilting the outboard engine. Tilting the outboard engine down collapses the barrier element in a manner that the barrier element does not interfere with normal functioning of the outboard engine and tilting the outboard engine up allows the barrier element to resume its original shape. The barrier system thus provides a passive mechanism for inhibiting marine growth on a submerged component of a boat that, once installed, requires little or no thought or maintenance, uses no electricity and is environmentally friendly.

In one aspect of the invention, a barrier system for inhibiting marine growth on a boat comprises a hull surface; a submerged component mounted to the hull surface; and a barrier element mounted to the hull surface, wherein the barrier element is positioned on the hull surface to provide when in a deployed position a body of stagnant water surrounding the submerged component.

In some embodiments, the barrier element is adjustable between the deployed position and a collapsed position, wherein the barrier element does not provide the body of stagnant water when in the collapsed position.

In some embodiments, the submerged component is an outboard engine mounting bracket.

In some embodiments, the barrier element is adjusted from the deployed position to the collapsed position incident to tilting down an outboard engine mounted to the mounting bracket.

In some embodiments, the barrier element is adjusted from the collapsed position to the deployed position incident to tilting up an outboard engine mounted to the mounting bracket.

In some embodiments, the barrier element is fully resilient.

In some embodiments, at least part of the barrier element is made of silicone.

In some embodiments, at least part of the barrier element is made of rubber.

In some embodiments, at least part of the barrier element is impregnated with an antifouling agent.

In some embodiments, at least part of the submerged component is made of aluminum.

In some embodiments, a top edge of the barrier element is above the waterline of the boat.

In some embodiments, the hull surface is a transom surface.

In some embodiments, the submerged component is partly submerged in the body of stagnant water when the barrier element is in the deployed position.

In some embodiments, the submerged component is completely submerged in the body of stagnant water when the barrier element is in the deployed position.

These and other aspects of the invention will be better understood by reference to the following detailed description taken in conjunction with the drawings that are briefly described below. Of course, the invention is defined by the appended claims.

DETAILED DESCRIPTION OF THE PREFERRED EMBODIMENT

Figure 1:
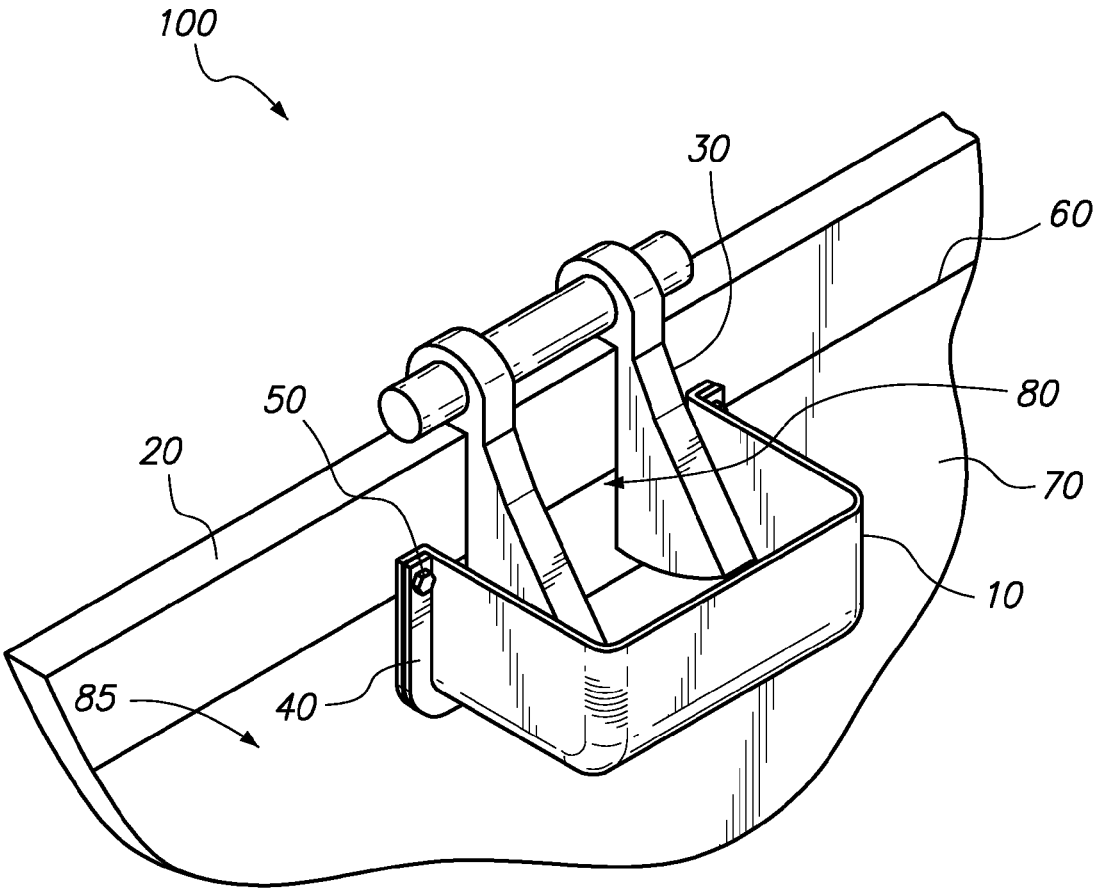
FIG. 1 shows the barrier system in a deployed mode wherein the barrier element restricts the exchange of water between the body of water enclosed within the barrier element and the body of water outside of the barrier element, thereby creating and maintaining a body of stagnant water surrounding the submerged component targeted for protection from fouling growth.

FIG. 1 shows a barrier system 100 in a deployed mode for inhibiting marine growth on a boat. Barrier system 100 is in the deployed mode when an outboard engine mounted to an aluminum outboard engine mounting bracket 30 that traverses the waterline 60 is in a tilted up position, such as when the boat is docked or moored. In the deployed mode, a barrier element 10 mounted to an exterior surface of a transom 20 of the boat is in a deployed position and provides a barrier between mounting bracket 30 and the open water 85 to a level above the waterline 60 of a boat. The top edge of barrier element 10 may be, for example, two or more inches above waterline 60. A body of stagnant water 80 is formed between barrier element 10 and transom 20, such that mounting bracket 30 is partly submerged in body of stagnant water 80. Barrier element 10 restricts the exchange of water between the body of stagnant water 80 enclosed within the barrier element 10 and the body of water 85 outside of the barrier element 10 which creates and maintains a body of stagnant water 80 around the mounting bracket 30. Restricted exchange between the body of stagnant water 80 enclosed within the barrier element 10 and the body of water 85 outside of the barrier element 10 deprives the ecosystem in stagnant body of water 80 of oxygen, carbon dioxide and nutrients, making the ecosystem more hostile to marine growth than the body of water 85 outside of barrier element 10. As a result, mounting bracket 30 is protected against fouling marine growth.

Barrier element 10 is mounted to the exterior surface of transom 20 using a backing plate 40 and mounting screws 50. Barrier element 10 surrounds the entire portion of mounting bracket 30 that is below waterline 60 and a small portion of mounting bracket 30 that is above waterline 60. Barrier element 10 is molded from a strong, waterproof, flexible and resilient material, such as rubber or silicone and may be impregnated with an antifouling agent. A portion of the exterior surface of transom 20 below waterline 60 is coated with copper paint 70 that does not come in contact with mounting bracket 30.

Figure 2:
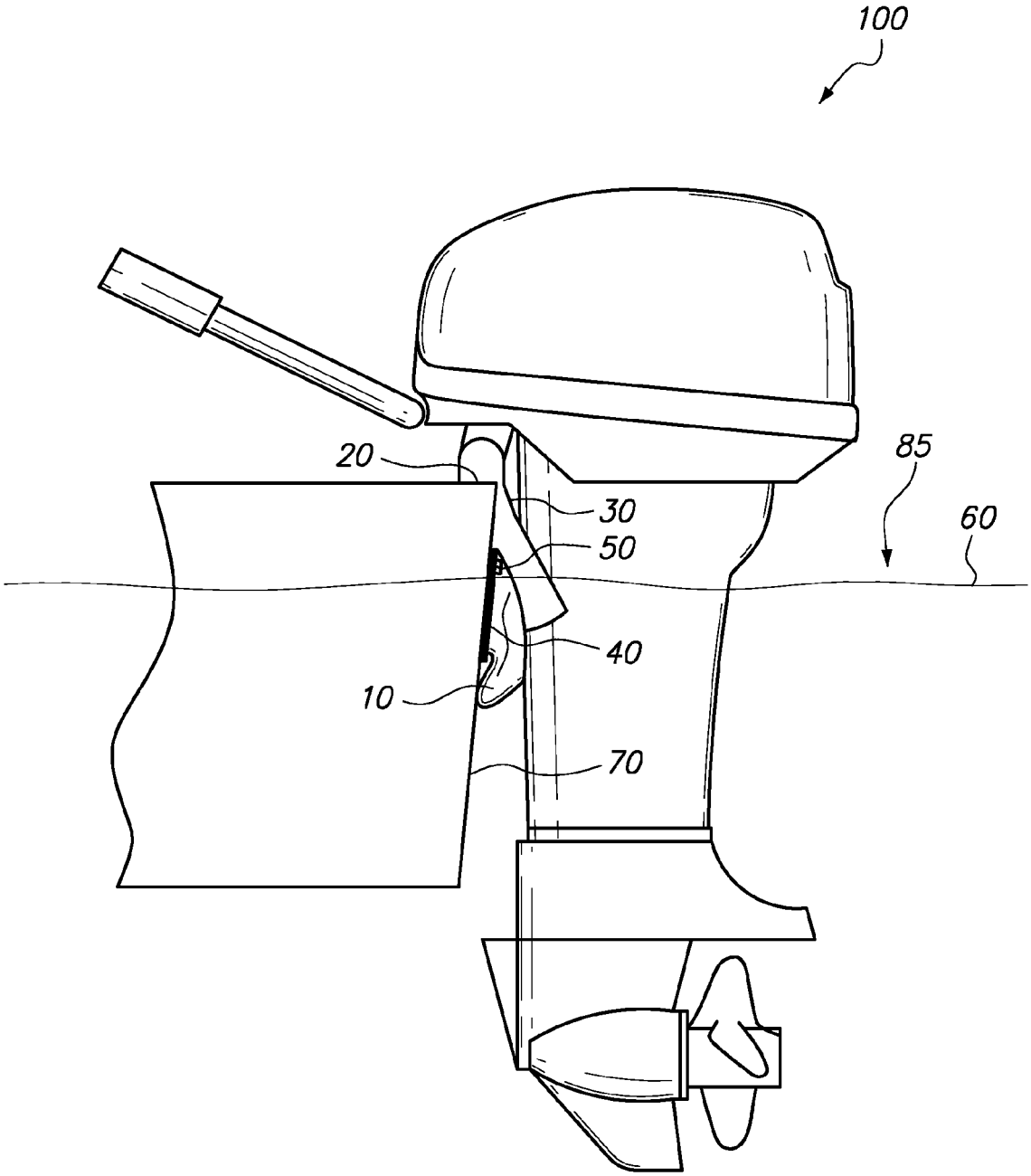
FIG. 2 shows the barrier system in a collapsed mode so as to not interfere with normal functioning of a deployed outboard engine mounted to the mounting bracket.

FIG. 2 shows barrier system 100 in the collapsed mode. Barrier system 100 is in the collapsed mode when outboard engine 90 mounted to mounting bracket 30 is in a tilted down position, such as when the boat is at sea and outboard engine 90 is powering the boat. In the collapsed mode, barrier element 10 is in a collapsed position and does not interfere with normal functioning of outboard engine 90. By the same token, barrier element 10 when in the collapsed position does not provide a barrier between mounting bracket 30 and the open water 85.

Barrier element 10 is freely adjustable between the deployed position and the collapsed position incident to a boater's act of tilting outboard engine 90 up and down, that is, the boater's act of moving outboard engine 90 between a tilted up position and a tilted down position. Barrier element 10 is fully resilient so that whenever the boater tilts outboard engine 90 up, barrier element 10 resumes the deployed position as illustrated in FIG. 1 regardless of how long barrier element 10 had previously been in the collapsed position.

It will be appreciated that waterline 60 may fluctuate within a range based on factors such as current boat load and wave action, for example.

It will be also appreciated by those of ordinary skill in the art that the invention can be embodied in other specific forms without departing from the spirit or essential character hereof. As one of numerous examples, the shape, size and material of the barrier element can vary. For example, the barrier element can be a hard shell with collapsible hinged sections. Moreover, while the illustrated embodiment describes protecting from marine growth an aluminum outboard engine mounting bracket mounted to a transom surface, the invention can be applied to safeguard other completely or partially submerged components, such as depth transducers or thru-hulls, mounted to other boat hull surfaces. Furthermore, rather than relying on the intrinsic resiliency of the barrier element to return the barrier element to its original shape when the outboard engine is tilted up, a spring or other decompression mechanism could be employed. The present description is therefore considered in all respects to be illustrative and not restrictive. The scope of the invention is indicated by the appended claims, and all changes that come within the meaning and range of equivalents thereof are intended to be embraced therein.

What is claimed is:

1. A barrier system for inhibiting marine growth on a boat, comprising:

a hull surface;

a submerged component mounted to the hull surface, wherein the submerged component is an outboard engine mounting bracket; and a barrier element mounted to the hull surface, wherein the barrier element is positioned on the hull surface to provide when in a deployed position a body of stagnant water surrounding the submerged component, wherein the barrier element is adjustable between the deployed position and a collapsed position, wherein the barrier element does not provide the body of stagnant water when in the collapsed position, and wherein the barrier element is adjusted from the deployed position to the collapsed position incident to tilting down an outboard engine mounted to the mounting bracket.

2. The barrier system of claim 1, wherein the barrier element is fully resilient.

3. The barrier system of claim 1, wherein at least part of the barrier element is made of silicone.

4. The barrier system of claim 1, wherein at least part of the barrier element is made of rubber.

5. The barrier system of claim 1, wherein at least part of the barrier element is impregnated with an antifouling agent.

6. The barrier system of claim 1, wherein at least part of the submerged component is made of aluminum.

7. The barrier system of claim 1, wherein a top edge of the barrier element is above a waterline of the boat.

8. The barrier system of claim 1, wherein the hull surface is a transom surface.

9. The barrier system of claim 1, wherein the submerged component is partly submerged in the body of stagnant water when the barrier element is in the deployed position.

10. The barrier system of claim 1, wherein the submerged component is completely submerged in the body of stagnant water when the barrier element is in the deployed position.

11. A barrier system for inhibiting marine growth on a boat, comprising:

a hull surface;

a submerged component mounted to the hull surface, wherein the submerged component is an outboard engine mounting bracket; and a barrier element mounted to the hull surface, wherein the barrier element is positioned on the hull surface to provide when in a deployed position a body of stagnant water surrounding the submerged component, wherein the barrier element is adjustable between the deployed position and a collapsed position, wherein the barrier element does not provide the body of stagnant water when in the collapsed position, and wherein the barrier element is adjusted from the collapsed position to the deployed position incident to tilting up an outboard engine mounted to the mounting bracket.

* * * * *